US011273568B2

(12) United States Patent
Bucks

(10) Patent No.: US 11,273,568 B2
(45) Date of Patent: Mar. 15, 2022

(54) IMPELLER, CENTRIFUGAL CUTTING APPARATUS COMPRISING SAME, AND METHOD OF OPERATING SAME

(71) Applicant: FAM, Kontich (BE)

(72) Inventor: Brent Bucks, Kontich (BE)

(73) Assignee: FAM, Kontich (BE)

( * ) Notice: Subject to any disclaimer, the term of this patent is extended or adjusted under 35 U.S.C. 154(b) by 0 days.

(21) Appl. No.: 16/208,608

(22) Filed: Dec. 4, 2018

(65) Prior Publication Data

US 2019/0168403 A1 Jun. 6, 2019

(30) Foreign Application Priority Data

Dec. 4, 2017 (EP) ..... 17205207

(51) Int. Cl.
*B26D 1/36* (2006.01)
*B26D 7/08* (2006.01)
(Continued)

(52) U.S. Cl.
CPC ..... *B26D 1/36* (2013.01); *B26D 1/0006* (2013.01); *B26D 3/26* (2013.01); *B26D 7/0691* (2013.01);
(Continued)

(58) Field of Classification Search
CPC ..... B26D 7/00; B26D 7/06; B26D 7/0691; B26D 3/26; B26D 3/28; B26D 1/03; B26D 1/34; B26D 1/36; B26D 1/38; B26D 7/08; B26D 7/26; B26D 7/2614; B26D 7/2628; B26D 7/2685; B26D 2210/02; B26D 1/0006; B26D 2001/0033; B26D 2001/0046; B26D 2001/0053;
(Continued)

(56) References Cited

U.S. PATENT DOCUMENTS 2,187,957 A * 1/1940 Urschel ..... B26D 3/18 83/395
2,187,958 A * 1/1940 Vigne ..... B61K 9/04 246/169 A
(Continued)

FOREIGN PATENT DOCUMENTS

KR 20090009925 10/2009

*Primary Examiner* — Evan H MacFarlane
(74) *Attorney, Agent, or Firm* — N.V. Nederlandsch Octrooibureau; Catherine A. Shultz; Katelyn J. Bernier

(57) ABSTRACT

Impeller for a centrifugal cutting apparatus, provided for being coaxially mounted within an annular-shaped cutting head and to be rotated inside the cutting head about a rotational axis in a rotational direction, the impeller comprising: a base plate, an annular cover plate and a plurality of circumferentially spaced paddles mounted between the base and cover plates. The paddles are oriented such that they have a first impelling surface directed towards the rotational direction and the circumference of the impeller, so as to drive the product that is admitted into the impeller forwards and outwards towards cutting elements mounted on the cutting head. The paddles have peripheral parts located at or near the circumference of the impeller. The peripheral parts of the paddle elements are provided with replaceable, removably mounted wear parts which form a second impelling surface on the respective paddle.

20 Claims, 12 Drawing Sheets

(51) Int. Cl.
*B26D 1/00* (2006.01)
*B26D 3/26* (2006.01)
*B26D 7/06* (2006.01)

(52) U.S. Cl.
CPC ..... *B26D 7/08* (2013.01); *B26D 2001/0033* (2013.01)

(58) Field of Classification Search
CPC ..... B26D 2001/0066; B26D 3/18; Y10T 83/6473; Y10T 83/6667; Y10S 83/932
USPC ..... 83/403, 733, 932
See application file for complete search history.

(56) References Cited

U.S. PATENT DOCUMENTS 2,436,410 A * 2/1948 Urschel ..... B26D 3/18 83/404.3
2,485,344 A * 10/1949 Annott ..... B26D 1/03 83/112
3,139,128 A * 6/1964 Urschel ..... B26D 1/03 83/111
4,391,172 A 7/1983 Galland et al.
4,610,397 A * 9/1986 Fischer ..... B02C 18/062 241/199.12
4,625,606 A * 12/1986 Pinegar ..... B26D 3/22 83/403
4,648,296 A * 3/1987 Wisdom ..... B26D 1/03 83/13
2008/0022822 A1* 1/2008 Jacko ..... B26D 1/03 83/403
2009/0202694 A1* 8/2009 Julian ..... B26D 1/38 426/506
2014/0041531 A1* 2/2014 Bucks ..... B26D 5/00 99/403
2014/0230621 A1* 8/2014 Bucks ..... B26D 1/36 83/403
2016/0158953 A1* 6/2016 King ..... B26D 7/08 83/13
2016/0318201 A1* 11/2016 Underwood ..... A23N 15/12

* cited by examiner

IMPELLER, CENTRIFUGAL CUTTING APPARATUS COMPRISING SAME, AND METHOD OF OPERATING SAME

FIELD OF THE INVENTION

The present invention relates to an impeller for a centrifugal (food) cutting apparatus and a (food) cutting apparatus equipped with such an impeller. In particular, aspects of the invention relate to impellers and centrifugal (food) cutting apparatuses for cutting (food) products of smaller sizes and/or and/or oblong shapes and/or abrasive products, like for example almonds, peanuts, coffee beans, strawberries, mushrooms, ginger root, olives and the like. Further aspects of the invention relate to a method of operating such a centrifugal cutting apparatus.

BACKGROUND ART

From U.S. Pat. No. 4,391,172 and US 2016/158953 A1, impellers are known which are optimised for smaller or reduced size food products. These known impellers have at least a first intermediate plate disposed between the base and the ring so as to define at least first and second tier levels within the impeller, and paddles disposed between the base and the ring and within the first and second tier levels. The first intermediate plate has an opening therein that defines a passage between the first and second tier levels. The impeller further has pockets defined by and between immediately adjacent pairs of paddles within each tier level.

It has been found that in the prior art impellers, especially when used for cutting abrasive products like for example almonds, the paddle parts are subject to abrasion and need to be replaced often.

SUMMARY OF THE INVENTION

It is a first aim of the present invention to provide an impeller and a centrifugal cutting apparatus which are optimised for use with abrasive (food) products.

It is a second aim of the present invention to provide an impeller and a centrifugal cutting apparatus which are optimised for use with (food) products of smaller sizes.

It is a third aim of the present invention to provide an impeller and a centrifugal cutting apparatus which are optimised for use with (food) products of oblong shapes.

The invention provides, according to a first aspect, an impeller for a centrifugal cutting apparatus, provided for being coaxially mounted within an annular-shaped cutting head and to be rotated inside the cutting head about a rotational axis in a rotational direction, the impeller comprising: a base plate closing one axial end of the impeller, an annular cover plate at the opposite axial end of the impeller defining a central opening for admission of product to be cut into the impeller, and a plurality of circumferentially spaced paddles mounted between the base and cover plates. The paddles are oriented such that they have a first impelling surface directed towards the rotational direction and the circumference of the impeller, so as to drive the product that is admitted into the impeller forwards and outwards towards cutting elements mounted on the cutting head. The paddles have peripheral parts located at or near the circumference of the impeller. The peripheral parts of the paddle elements are provided with replaceable, removably mounted wear parts which form a second impelling surface on the respective paddle. This means that the wear parts are oriented so as to further drive the product that is being cut forwards and outwards towards the cutting elements mounted on the cutting head.

The wear parts, which are replaceable and removably mounted on the impeller, are located in front of the peripheral parts of the impeller paddles, i.e. they overtake the impelling function of the peripheral parts of the impeller paddles, which would otherwise be the parts of the impeller paddles which are most subjected to wear. The wear parts, being removably mounted, can thus be easily and quickly replaced when needed or desired, for example when they have worn to a certain extent, and the life of the impeller paddles themselves can be extended as compared to impeller paddles without the wear parts. So by the provision of the wear parts, the impeller is optimised for use with abrasive products, such as for example almonds, peanuts, coffee beans, strawberries, mushrooms, ginger root, olives and the like.

In embodiments according to the invention, the wear parts may be removably fixed to the impeller paddles, for example by means of one or more bolts. Preferably, the wear parts protrude from the first impelling surface. Preferably, the wear parts are removably fixed in a corresponding slot which is each time provided in the peripheral part of the paddle and provided to accommodate the wear parts. The advantage of this slot is on the one hand that a well-defined position for the wear part is provided, facilitating the mounting thereof on the paddle, and on the other hand that it can be avoided that as the first impelling surface wears (which can happen to a certain extent), product that is being cut could be pushed into the crevice between the paddle and the wear part.

In embodiments according to the invention, the impeller may further comprise at least one annular divider plate disposed axially between said base and cover plates and generally in parallel therewith. This has the advantage that the flow of product to be cut can be divided over multiple impeller levels for engagement with the cutting edges of the cutting elements on the surrounding cutting head along substantially the entire axial length of these cutting elements, thus potentially increasing the production rate and/or prolonging the period of use of the cutting elements between replacement or resharpening.

In embodiments according to the invention, the wear parts may function as positioning elements for positioning the at least one divider plate axially between said base and cover plates. This means that there are separate wear parts in each impeller level and that they are dimensioned such that they each time have a top face which supports the divider plate of the level directly above. Alternatively stated, the at least one divider plate is each time held in position between the top faces of the wear parts immediately below and the bottom faces of the wear parts immediately above the respective divider plate.

In embodiments according to the invention, the at least one divider plate may comprise holes dimensioned for accommodating the paddles, said holes being located inwards from the circumference of the respective divider plate, such that the circumference of the divider plate is a continuous ring. This means that the parts of the divider plates in between the successive paddles are connected to each other at the circumference of the plate, i.e. there is no interruption at the circumference. This is advantageous for the strength of the divider plate and can avoid that the parts in between the paddles can bend upwards or downwards.

In a second aspect, which may be combined with the other aspects and embodiments described herein, the invention provides an impeller for a centrifugal (food) cutting apparatus, provided for being coaxially mounted within an annular-shaped cutting head and to be rotated inside the cutting head about a rotational axis in a rotational direction, the impeller comprising: a base plate closing one axial end of the impeller, an annular cover plate at the opposite axial end of the impeller defining a central opening for admission of product to be cut into the impeller, and a plurality of circumferentially spaced paddles mounted between the base and cover plates. The paddles are oriented such that they have a first impelling surface directed towards the rotational direction and the circumference of the impeller, so as to drive the product that is admitted into the impeller forwards and outwards towards cutting elements mounted on the cutting head. The paddles have peripheral parts located at or near the circumference of the impeller. The peripheral parts of the paddle elements are provided with additional impelling parts which form a second impelling surface on the respective paddle, adjacent the first impelling surface. This second impelling surface is oriented so as to further drive the product that is being cut forwards and outwards towards the cutting elements mounted on the cutting head. The first impelling surfaces are generally oriented at an angle below 45° with respect to a tangent line drawn at the intersection of the impeller circumference with the respective first impelling surface. The second impelling surfaces are preferably generally oriented at an angle above 45° with respect to a tangent line drawn at the intersection of the impeller circumference respective with the respective first impelling surface.

The additional impelling parts according to the second aspect may be the wear parts according the first aspect, though not necessarily. The invention according to the second aspect encompasses embodiments in which the additional impelling parts are components of the paddles themselves.

The first impelling surface, being generally oriented in an angle lower than 45° with respect to a tangent line drawn on the circumference of the impeller at the the intersection with the direction of the respective first impelling surface, or in case of a curved first impelling surface a tangent line thereto along the general direction of the first impelling surface, is oriented so as to strongly push the product outwards. This has been found to be beneficial for smaller sized (food) product which has a lower mass. The second impelling surface, being generally oriented at a larger angle with respect to a tangent line drawn on the circumference of the impeller at the intersection with the direction of the second impelling surface. This has been found to be beneficial to ensure that thin leftover parts of the product are pushed out and exit the cutting head via the openings at the knives and to avoid that such thin leftover parts could jam the apparatus.

In embodiments according to the invention, the first impelling surfaces may be generally oriented at an angle between 20° and 30° with respect to a tangent line drawn at the intersection of the impeller circumference with the respective first impelling surface. Such smaller angles have been found to be further beneficial for smaller sized (food) product as the product is pushed outwards more strongly. Examples of such smaller sized product have been mentioned elsewhere herein; additional examples are peas, chickpea, soybeans and the like. For oblong product, the angle according to this embodiment can create a narrow opening that the product must enter before being cut, which can aid in pushing the product in a lengthwise orientation before being cut.

In embodiments according to the invention, the impeller may be provided for use with (food) product of a predetermined average size and oblong shape, wherein the first impelling surfaces are generally oriented to direct a longitudinal axis of such product parallel to a tangent line drawn at the impeller circumference at the point where the product engages with the cutting elements. This orientation is thus optimized for orienting the product of oblong shape to obtain oblong or oval cuts along the longitudinal axis of the product.

In embodiments according to the invention, the second impelling surfaces may be generally oriented at an angle between 60° and 80° with respect to a tangent line drawn at the intersection of the impeller circumference with the respective second impelling surface. This has been found to be further beneficial to ensure that thin leftover parts of the product are pushed out and exit the cutting head via the openings at the knives and to avoid that such thin leftover parts could jam the apparatus.

In a third aspect, which may be combined with the other aspects and embodiments described herein, the invention provides an impeller for a centrifugal (food) cutting apparatus, provided for being coaxially mounted within an annular-shaped cutting head and to be rotated inside the cutting head about a rotational axis in a rotational direction, the impeller comprising: a base plate closing one axial end of the impeller, an annular cover plate at the opposite axial end of the impeller defining a central opening for admission of product to be cut into the impeller, and a plurality of circumferentially spaced paddles mounted between the base and cover plates. The paddles are oriented such that they have a first impelling surface directed towards the rotational direction and the circumference of the impeller, so as to drive the product that is admitted into the impeller forwards and outwards towards cutting elements mounted on the cutting head. The impeller is provided for use with (food) product of a predetermined average size and oblong shape with an average length L measured along the longitudinal axis of the product. Thereto, the paddles have back sides opposite the first impelling surfaces which are preferably concave and are oriented so as to guide such product that is admitted into the impeller along a trajectory towards the subsequent paddle (subsequent in rotational direction). The paddles further have inner extremities, located inwards from the impeller circumference, which are positioned a predetermined distance from said trajectory, said predetermined distance being between L/2 and L, such that the inner extremity can intercept such product travelling along the trajectory and rotate it into an orientation desired for cutting, in particular an orientation in which the product is generally cut along its longitudinal axis.

In embodiments according to the invention, the first impelling surfaces may be convex, preferably with substantially the same radius of curvature as the concave back sides.

In embodiments according to the invention, the radius of curvature of the back sides may be substantially the same as that on the inside of the cutting stations of the cutting head surrounding the impeller.

In a fourth aspect, which may be combined with the other aspects and embodiments described herein, the invention provides an impeller for a centrifugal (food) cutting apparatus, provided for being coaxially mounted within an annular-shaped cutting head and to be rotated inside the cutting head about a rotational axis in a rotational direction, the impeller comprising: a base plate closing one axial end of the impeller, an annular cover plate at the opposite axial end of the impeller defining a central opening for admission of product to be cut into the impeller, and a plurality of circumferentially spaced paddles mounted between the base and cover plates. The paddles are oriented such that they have a first impelling surface directed towards the rotational direction and the circumference of the impeller, so as to drive the product that is admitted into the impeller forwards and outwards towards cutting elements mounted on the cutting head. Furthermore, the paddles are curved and oriented to develop a fluid stream (e.g. air, water, or oil) through the centrifugal cutting apparatus. In particular, the impeller paddles may be formed like blades of a centrifugal fan. In this way, during operation, the (food) product is moved towards the cutting elements on the cutting head by means of centrifugal force as well as the fluid stream. This can be particularly advantageous for (food) products of smaller sizes.

In other aspects, the invention relates to a centrifugal cutting apparatus comprising the impeller described above and a method of using such a centrifugal cutting apparatus.

BRIEF DESCRIPTION OF THE DRAWINGS

The present invention will be discussed in more detail below, with reference to the attached drawings.

DESCRIPTION OF EMBODIMENTS

Figure 1:
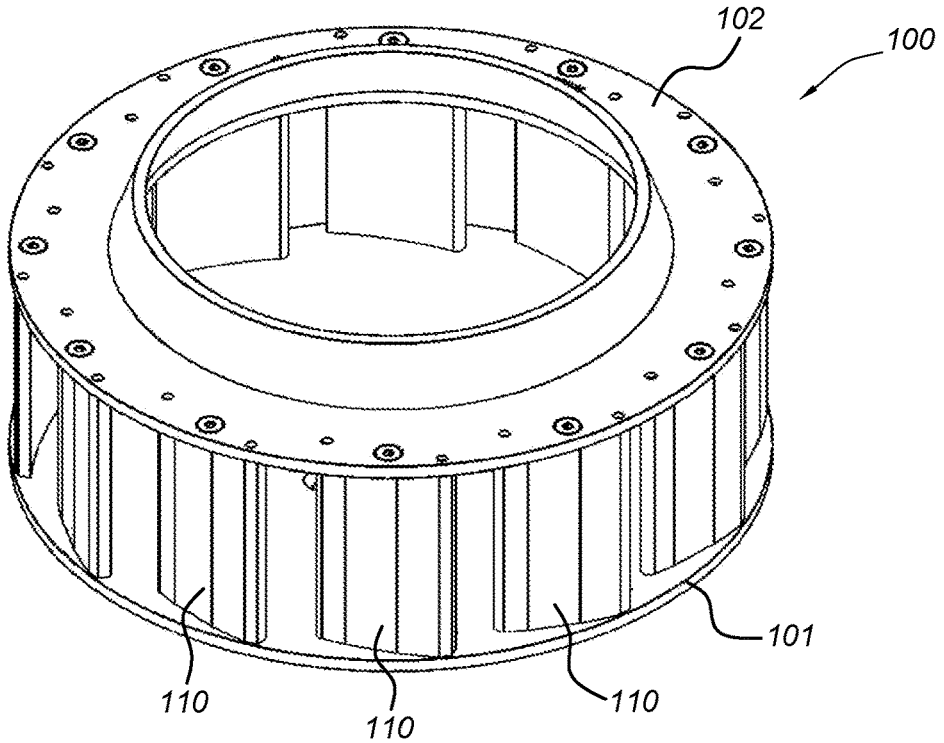
FIG. 1 shows a perspective view of a first embodiment of an impeller for a centrifugal cutting apparatus.

The present invention will be described with respect to particular embodiments and with reference to certain drawings but the invention is not limited thereto but only by the claims. The drawings described are only schematic and are non-limiting. In the drawings, the size of some of the elements may be exaggerated and not drawn on scale for illustrative purposes. The dimensions and the relative dimensions do not necessarily correspond to actual reductions to practice of the invention.

Furthermore, the terms first, second, third and the like in the description and in the claims, are used for distinguishing between similar elements and not necessarily for describing a sequential or chronological order. The terms are interchangeable under appropriate circumstances and the embodiments of the invention can operate in other sequences than described or illustrated herein.

Moreover, the terms top, bottom, over, under and the like in the description and the claims are used for descriptive purposes and not necessarily for describing relative positions. The terms so used are interchangeable under appropriate circumstances and the embodiments of the invention described herein can operate in other orientations than described or illustrated herein.

Furthermore, the various embodiments, although referred to as "preferred" are to be construed as exemplary manners in which the invention may be implemented rather than as limiting the scope of the invention.

The term "comprising", used in the claims, should not be interpreted as being restricted to the elements or steps listed thereafter; it does not exclude other elements or steps. It needs to be interpreted as specifying the presence of the stated features, integers, steps or components as referred to, but does not preclude the presence or addition of one or more other features, integers, steps or components, or groups thereof. Thus, the scope of the expression "a device comprising A and B" should not be limited to devices consisting only of components A and B, rather with respect to the present invention, the only enumerated components of the device are A and B, and further the claim should be interpreted as including equivalents of those components.

In the following, embodiments of impellers 100, 200 according to one or more aspects of the invention will be described with reference to the enclosed drawings. Examples of cutting heads and centrifugal cutting apparatuses with which the impellers 100, 200 can be used are shown in the following patent publications, which are incorporated herein by reference: WO 2012/139988 A1, "Apparatus and method for cutting products"; WO 2012/139991 A1, "Apparatus and method for cutting products"; WO 2013/045684 A1, "Cutting head assembly for centrifugal cutting apparatus and centrifugal apparatus equipped with same"; WO 2013/045685 A1, "Impeller for centrifugal food cutting apparatus and centrifugal food cutting apparatus comprising same"; EP 2918384 A1, "Cutting head assembly for a centrifugal cutting apparatus and centrifugal apparatus equipped with same"; WO 2015/075180 A1, "Knife assembly for corrugated knife blade and cutting system equipped with same"; WO 2015/075179 A1, "Knife assembly for flat knife blade and cutting system equipped with same". The impellers 100, 200 may further be used on other centrifugal cutting apparatuses.

A first embodiment of an impeller 100 according to one or more aspects of the invention is described with reference to FIGS. 1 and 2. This first embodiment provides an impeller for a centrifugal cutting apparatus, provided for being coaxially mounted within an annular-shaped cutting head and to be rotated inside the cutting head about a rotational axis in a rotational direction. The impeller 100 comprises a base plate 101 and a cover plate 102 spaced axially from each other, the cover plate defining an entrance side of the impeller via which food product to be cut is fed into the impeller and the base plate 101 closing off the other side of the impeller. A plurality of circumferentially spaced paddles 110 are mounted between the base and cover plates, each of the paddles having a peripheral part 111 at or near the circumference of the impeller and an inner extremity 112 inwards from the circumference. The paddles are oriented such that they define a first impelling surface 113 which extends from the inner extremity to the peripheral part. The paddles are oriented such that the first impelling surface 113 is directed towards the rotational direction of the impeller and towards its circumference, so as to drive the food product F forwards and outwards towards the knives or cutting elements mounted on the cutting head (not shown). The impeller has curved impeller paddles 110, generally oriented in an angle $\alpha$ lower than 45°, more preferably lower than 30°, with respect to a tangent line drawn on the circumference of the impeller at the intersection with the general direction of the respective first impelling surface 113 (in this case, in view of the curved first impelling surface, a tangent line thereto). This angle α is preferred to strongly push the product F outwards and is thus optimized for product F of relatively small size.

The impeller is further optimized for oblong product F, e.g. almonds or other oblong product mentioned herein, with the inner extremities 112 of the paddles 110 positioned for intercepting undesirably oriented product and rotating it into an orientation desired for cutting, as will be described in detail below for other embodiments.

The paddles 110 preferably have back sides 115 opposite the first impelling surfaces 113 which are concave and are oriented so as to guide such product F that is admitted into the impeller via the open cover plate 102, along a trajectory towards the subsequent paddle 110, which is subsequent in the rotational direction, as will be described in detail below for other embodiments.

Figure 2:
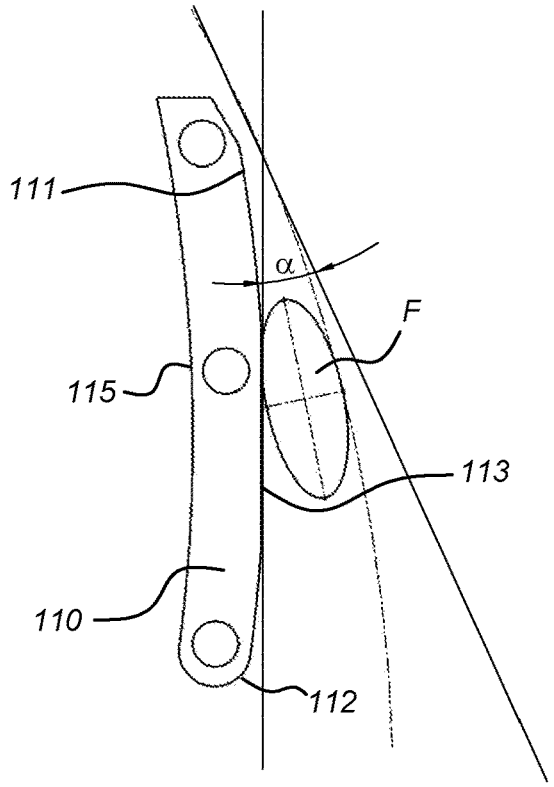
FIG. 2 shows a cross-section through an impeller paddle of the embodiment of FIG. 1, in use while impelling a food product.
Figure 3:
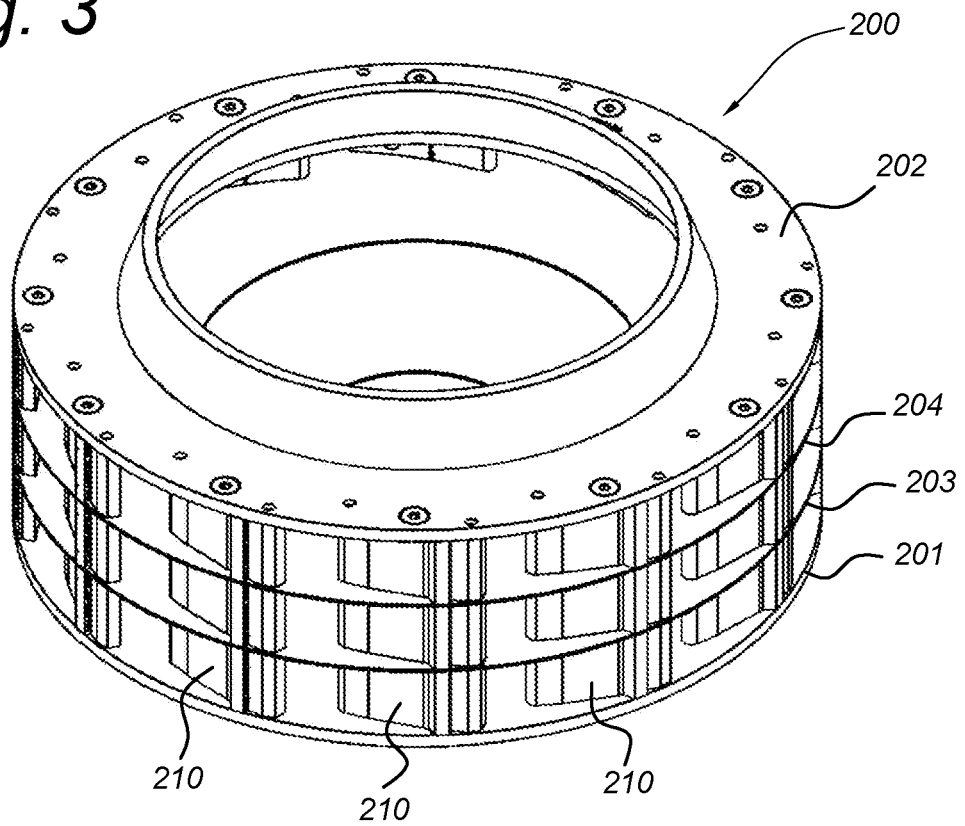
FIG. 3 shows a perspective view of a second embodiment of an impeller for a centrifugal cutting apparatus.

As is clear from FIG. 2, the paddles 110 are generally curved. Furthermore, they are preferably shaped and oriented to develop a fluid stream (e.g. air, water, or oil) through the centrifugal cutting apparatus upon rotation of the impeller. In particular, the impeller paddles 110 are shaped and oriented like blades of a centrifugal fan and configured to draw fluid from the interior space of the impeller 100 and push the fluid out through the exit openings provided at the cutting elements on the cutting head. In this way, during operation, the (food) product F can be moved towards the cutting elements on the cutting head by means of centrifugal force as well as the fluid stream. This can be particularly advantageous for (food) products F of smaller sizes.

A second embodiment of an impeller 200 according to the invention, in which many aspects of the invention are combined, is described with reference to FIGS. 3 to 8. and relates to an impeller 200 for a centrifugal cutting apparatus which is optimized for abrasive products, in particular abrasive food products. The impeller is adapted to be coaxially mounted within an annular-shaped cutting head and to be rotated inside the cutting head about a rotational axis (the axis of the cutting head and the impeller) in a rotational direction, in this case clockwise.

Figure 5:
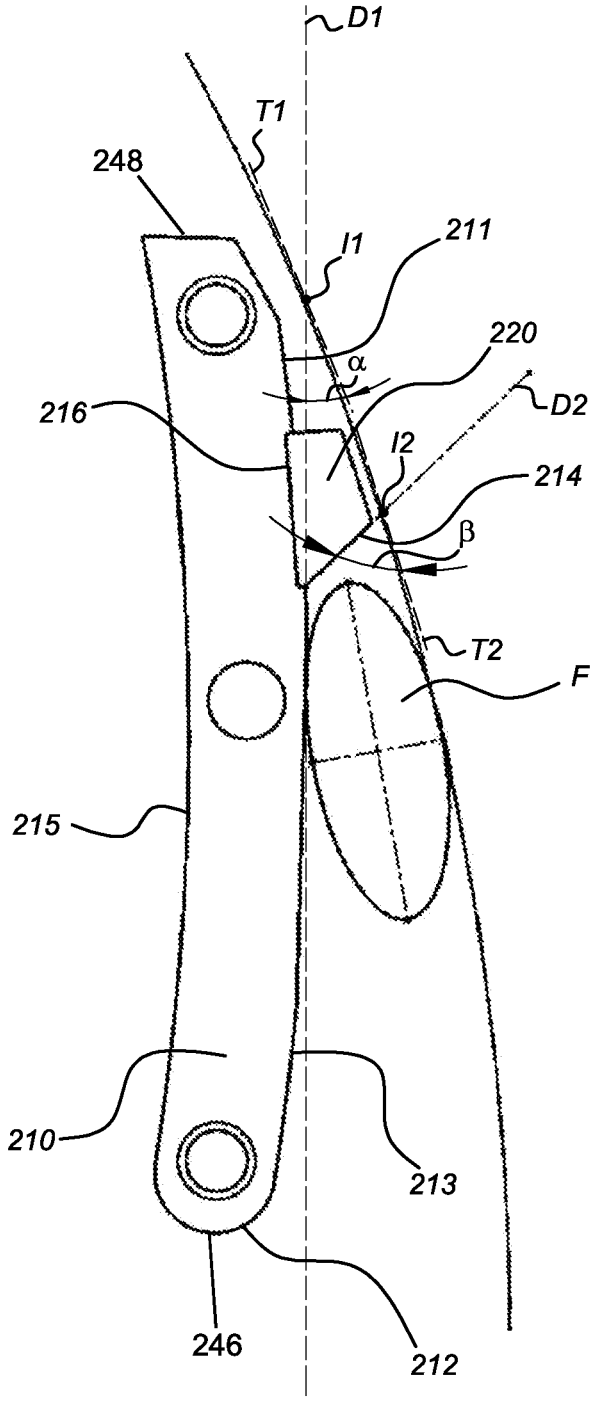
FIGS. 5 and 6 show cross-sections through an impeller paddle of the embodiment of FIG. 3, in use while impelling a food product.

The impeller 200 comprises a base plate 201 and a cover plate 202 spaced axially from each other, the cover plate 202 defining an entrance side of the impeller via which food product to be cut is fed into the impeller and the base plate 201 closing off the other side of the impeller. A plurality of circumferentially spaced paddles 210 are mounted between the base and cover plates, each of the paddles having a peripheral part 211 at or near the circumference of the impeller and an inner extremity 212 inwards from the circumference. The paddles are oriented such that they define a first impelling surface 213 which extends from the inner extremity to the peripheral part. The paddles are oriented such that the first impelling surface 213 is directed towards the rotational direction of the impeller and towards its circumference, so as to drive the food product forwards and outwards towards the knives or cutting elements mounted on the cutting head. The peripheral parts 211 of the paddles 210 are provided with replaceable, removably mounted wear parts 220 which form a second impelling surface 214 on the respective paddle. These wear parts are located in front of the peripheral parts of the impeller paddles, i.e. they overtake the impelling function of the peripheral parts of the impeller paddles, which would otherwise be the parts of the impeller paddles which are most subjected to wear. The wear parts 220, being removably mounted, can be easily and quickly replaced when needed or desired, for example when they have worn to a certain extent, and the life of the impeller paddles themselves can be extended as compared to impeller paddles without the wear parts. As shown in FIG. 5, each of the paddles 210 has an inner edge 246 and an outer edge 248.

The peripheral part 211 of the impeller paddle is provided with a slot 216 for receiving the wear part 220, which is fixed thereto by means of bolts. The purpose of this slot 216 is on the one hand to have a defined position for the wear part 220, facilitating the mounting thereof on the paddle, and on the other hand to avoid that as the first impelling surface 213 wears (which can happen to a certain extent), food product could be pushed into the crevice between the paddle 210 and the wear part 220. In alternative embodiments (not shown), the wear parts can also be removably fixed directly to the base and cover plates.

The wear parts 220 may be manufactured from the same material as the impeller paddles 210, or a wear optimised material such as a ceramic material, wear-coated steel, or other.

The impeller of FIGS. 3-8 comprises two divider plates 203, 204 which are disposed axially between the base 201 and cover 202 plates and generally parallel therewith, hence dividing the impeller into three tier levels or impeller levels. In the embodiment shown, there are two such divider plates which define a first tier level being between the cover plate 202 and the first divider plate 204, a second tier level being between the first divider plate 204 and the second divider plate 203, and a third tier level being between the second divider plate 203 and the base 201. The first divider plate 204 has a first central opening 205 therein that defines a passage between the first and second tier levels and the second divider plate has a second opening 206 therein, smaller than the first opening, that defines a passage between the second and third tier levels. Embodiments according to the invention may have a different number of divider plates to define for example two, four, five, six or more tier levels. The provision of divider plates has the advantage that the flow of product to be cut can be divided over multiple impeller levels for engagement with the cutting edges of the cutting elements on the surrounding cutting head along substantially the entire axial length of these cutting elements, thus potentially increasing the production rate and/or prolonging the period of use of the cutting elements between replacement or resharpening.

The wear parts 220 may further function as positioning elements or spacers for positioning the at least one divider plate 203, 204 axially between said base 201 and cover 202 plates. This means that there are separate wear parts 220 in each impeller level and that they are dimensioned such that they each time have a top face 221 which supports the divider plate of the level directly above. Alternatively stated, each divider plate 203, 204 is each time held in position between the top faces 221 of the wear parts 220 immediately below and the bottom faces of the wear parts 220 immediately above the respective divider plate.

The divider plates 203, 204 comprise holes 207, 208 dimensioned for accommodating the paddles 210, said holes being located inwards from the circumference of the respective divider plate, such that the circumference of the divider plate 203, 204 is a continuous ring. This means that the parts of the divider plates in between the successive paddles are connected to each other at the circumference of the plate, i.e. there is no interruption at the circumference. This is advantageous for the strength of the divider plate and can avoid that the parts in between the paddles can bend upwards or downwards.

The assemblage of the impeller with the divider plates is shown in the sequence of FIG. 4A-F FIG. 4A shows the base plate 201 with the paddles 210 mounted thereon. The fixture between the base plate 201 and the paddles 210 can be carried out in many ways known to the person skilled in the art. The wear parts 220 of the lowest tier level fixed to the paddles 210, in particular in the slots 2016. In the embodiment shown, this fixture is carried out by means of two bolts through the paddle, but this can also be carried out otherwise (see below). The top surfaces 221 of the wear parts 220 forms a supporting surface for the intermediate plate 203.

Figure 4A:
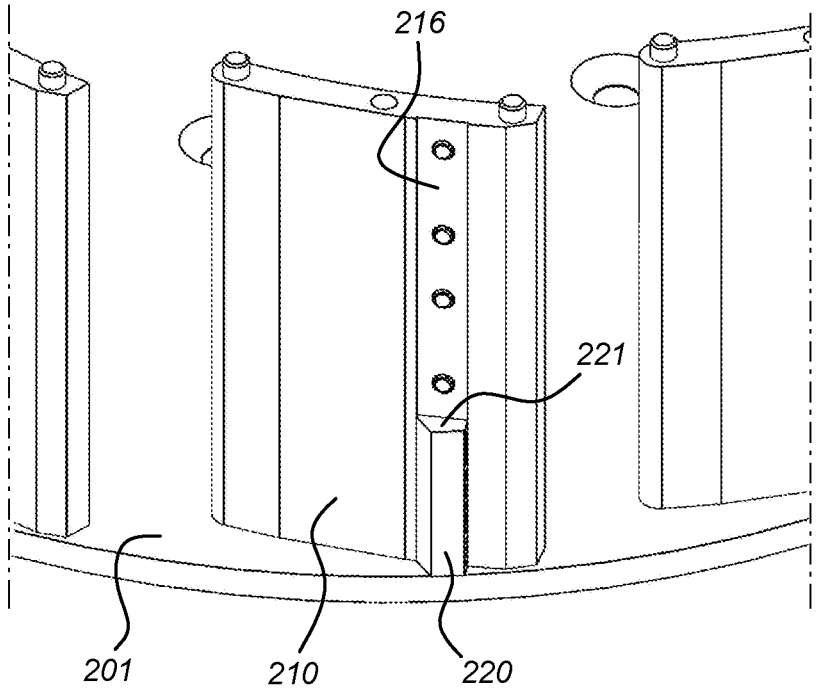
FIG. 4A-F shows how the impeller of FIG. 3 is assembled.
Figure 4B:
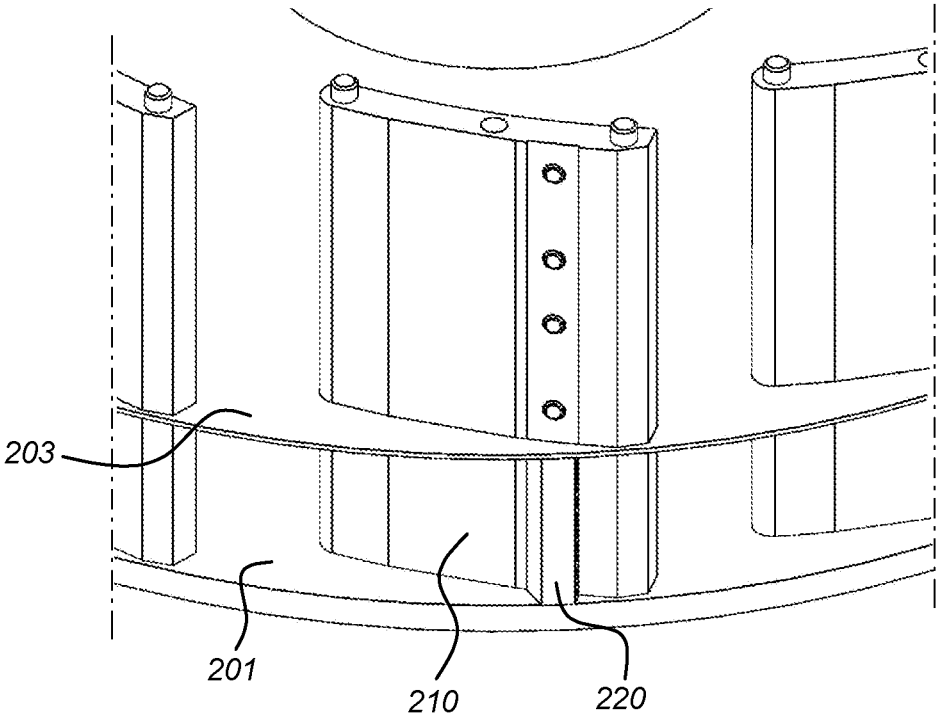

FIG. 4B shows the result of the next assemblage step. The intermediate plate 203 is brought in from the top side. The holes 208 of the plate 203 are aligned with the paddles 210 and then the plate 203 is moved down over the paddles 210 until it rests on the top surfaces 221 of the wear parts 220 of the lower level.

Figure 4C:
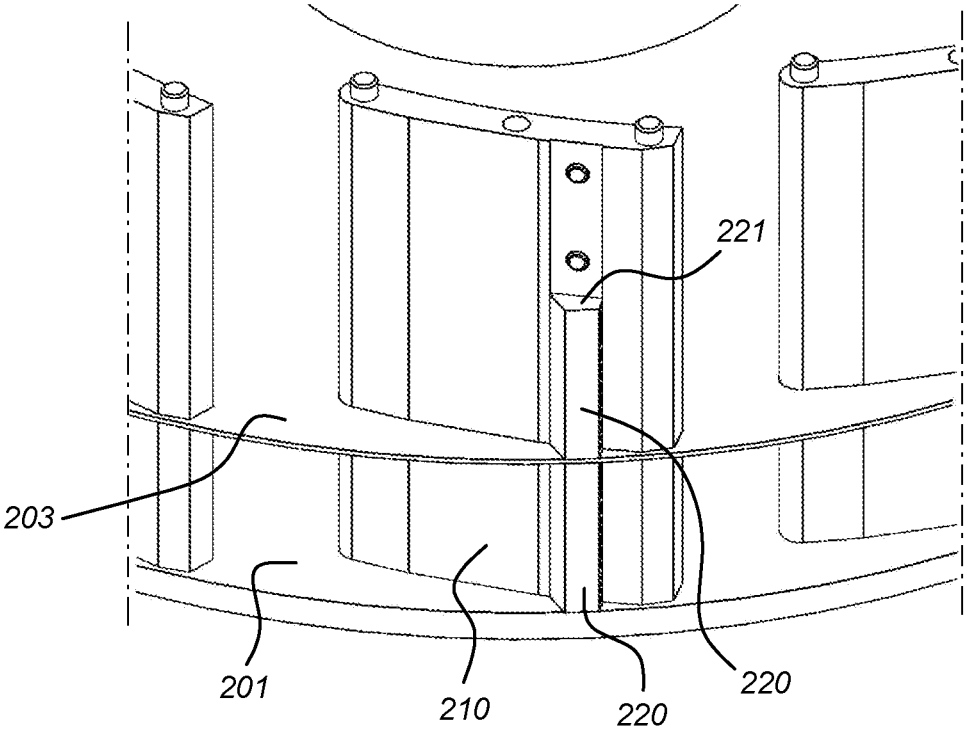

FIG. 4C shows the result of the next assemblage step. Wear parts 220 are mounted above the intermediate plate 203. So the intermediate plate 203 is afterwards held in position by the wear parts 220 above and below.

Figure 4D:
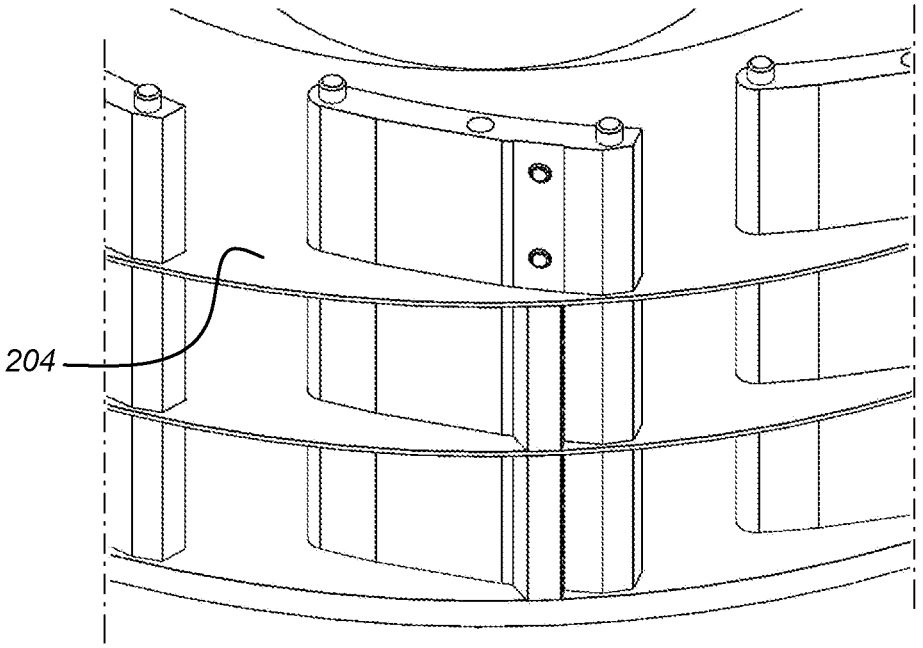

FIG. 4D shows the result of the next assemblage step. The intermediate plate 204 is brought in from the top side. The holes 207 of the plate 204 are aligned with the paddles 210 and then the plate 204 is moved down over the paddles 210 until it rests on the top surfaces 221 of the wear parts 220 of the lower level.

Figure 4E:
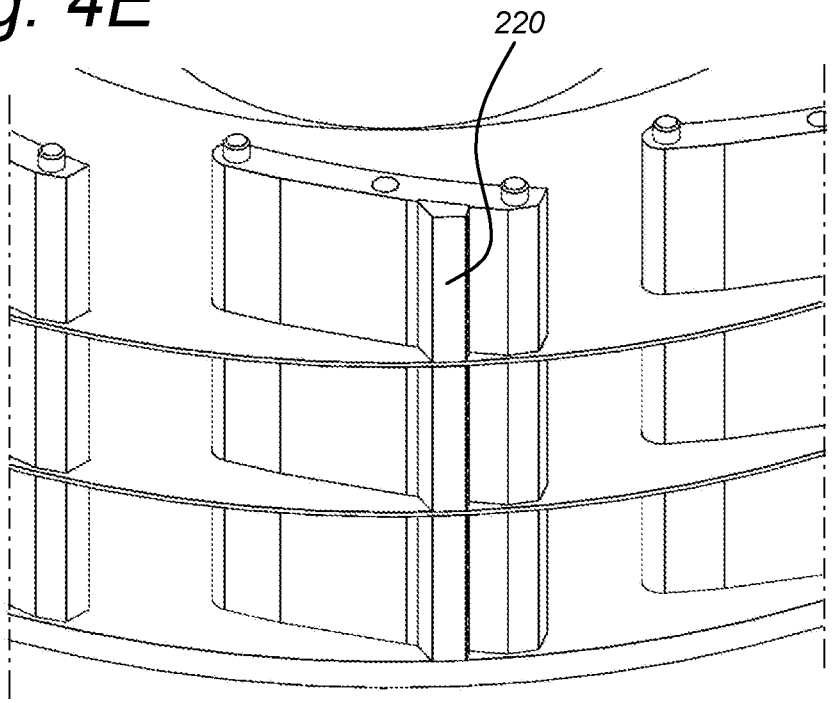

FIG. 4E shows the result of the next assemblage step. Wear parts 220 are mounted above the intermediate plate 204. So the intermediate plate 204 is afterwards held in position by the wear parts 220 above and below.

Figure 4F:
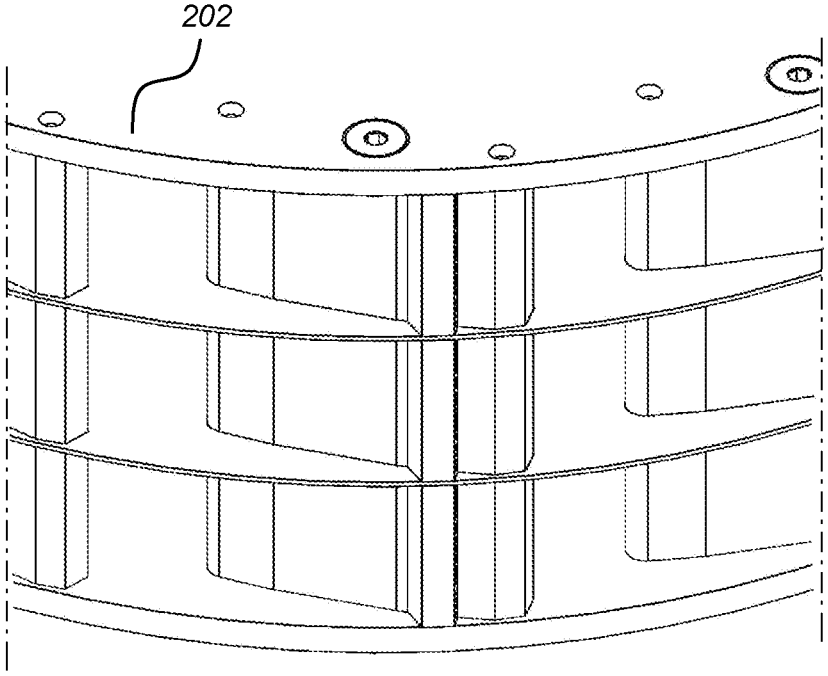

FIG. 4F shows the final assemblage step. The cover plate 201 is placed on top of the paddles 210 and bolted thereto.

Referring to FIG. 5, the first impelling surface 213 is generally oriented in an angle $\alpha$ lower than 45° with respect to a tangent line T1 drawn on the circumference of the impeller at the intersection I1 with the general direction D1 of the first impelling surface 213. In the embodiment shown, the first impelling surface is curved, convex in forwards rotation direction, and the general direction D1 is defined as a tangent line to the middle of the curved surface 213. This angle lower than 45°, preferably between 20° and 30°, is preferred so as to strongly push the product outwards during rotation. This has been found to be beneficial for smaller sized food product which has a lower mass.

The wear part 220 is an additional impelling part which provides a second impelling surface 214 at a larger angle $\beta$ with respect to a tangent line T2 drawn on the circumference of the impeller at the intersection I2 between the plane D2 of the second impelling surface with the circumference. In particular, an angle $\beta$ above 45° is preferred, with a preferred range between 60° and 80°. This has been found to be beneficial to ensure that thin leftover parts of the product are pushed out and exit the cutting head via the openings at the knives and to avoid that such thin leftover parts could jam the apparatus.

Figure 6:
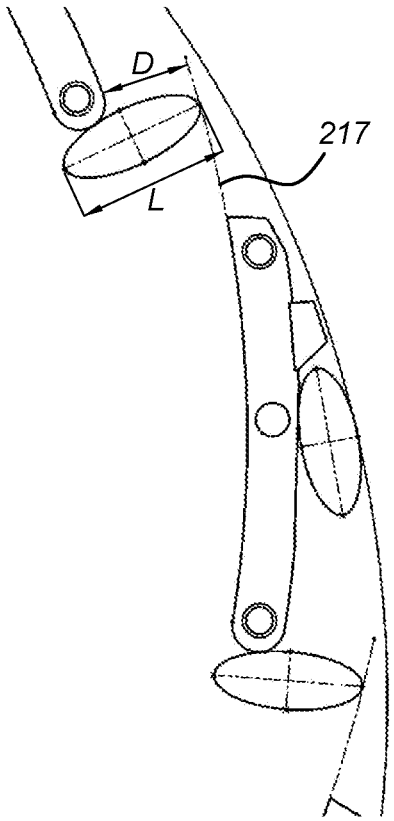
Figure 7:
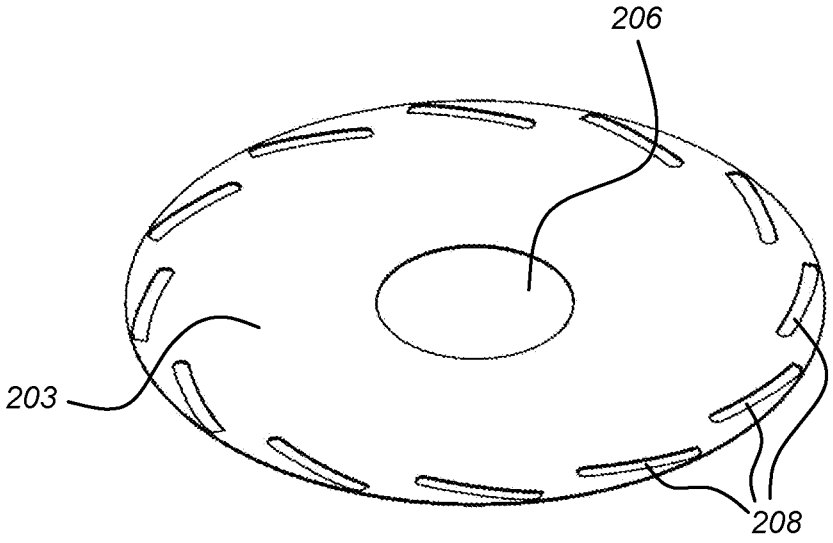
FIGS. 7 and 8 show perspective views of intermediate plates of the impeller of FIG. 3.
Figure 8:
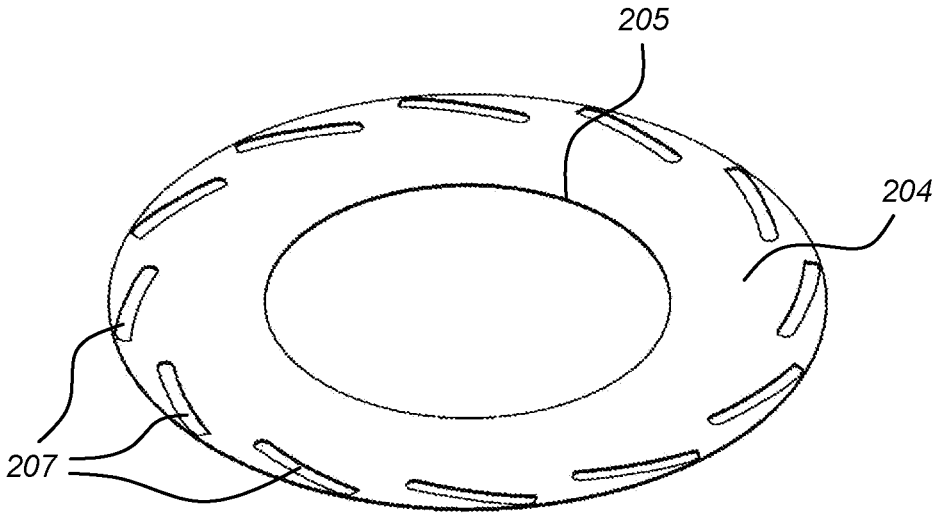

The impeller 200 is further provided for use with (food) product F of a predetermined average size and oblong shape with an average length L measured along the longitudinal axis of the product, for example almonds F, one of which is shown in FIGS. 5 and 6. Thereto, the paddles 210 have back sides 215 opposite the first impelling surfaces 213 which are concave and are oriented so as to guide such product, e.g. almonds F, that is admitted into the impeller 200 via the open cover plate 202, along a trajectory 217 towards the subsequent paddle 210, which is subsequent in the rotational direction. The paddles further have inner extremities 212, located inwards from the impeller circumference, which are positioned a predetermined distance D from said trajectory 116, said predetermined distance D being between L/2 and L. In this way, the product (almond) F that travels along the trajectory 217 in an undesired orientation for cutting, as shown in FIG. 6, can be intercepted by the inner extremity 212 at a point behind the centre of gravity of the product (almond) F and push on the back end of the product to rotate it into the orientation which is generally desired for cutting, in particular an orientation in which the product is generally cut along its longitudinal axis L. The inner extremities 212 are preferably rounded and/or may be covered with a softer material so as to minimize the risk of damage to the product by impact.

Figure 12:
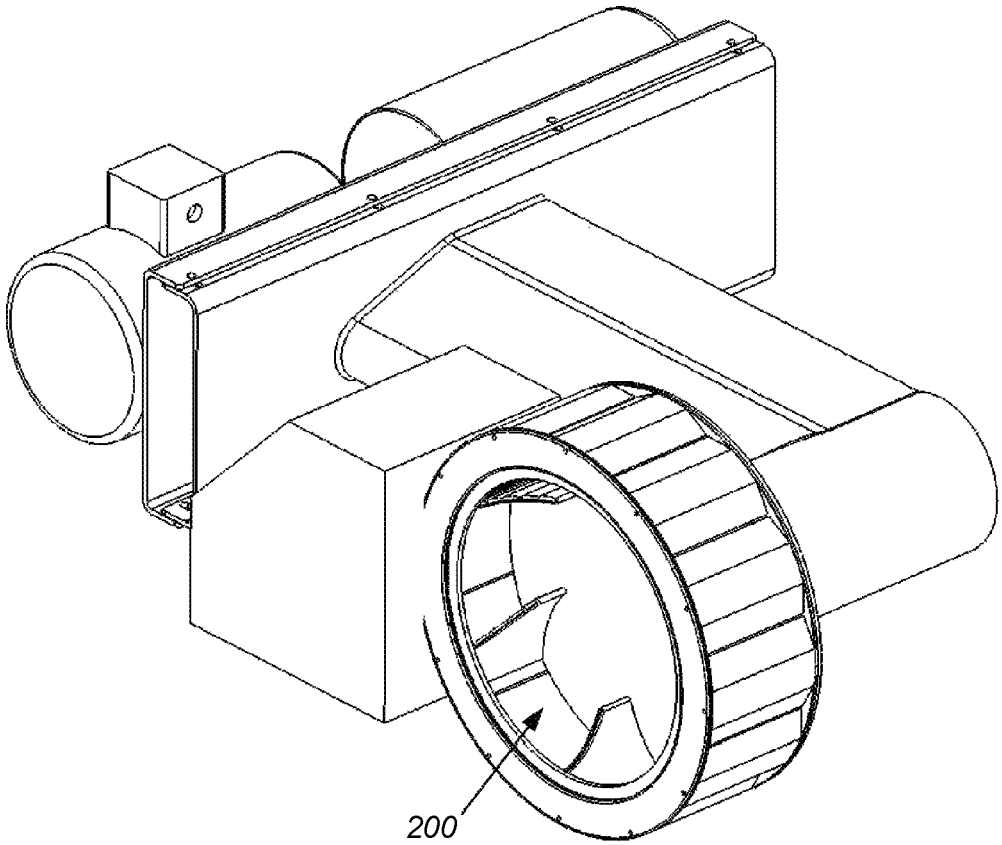
Prior Art Fig. 12
FIG. 12 shows a cross sectional perspective view of a centrifugal cutting apparatus comprising an impeller.

As shown, the first impelling surfaces 213 may be convex, preferably with substantially the same radius of curvature as the concave back sides 215. Further, the radius of curvature of the back sides 215 may be substantially the same as that on the inside of the cutting stations of the cutting head surrounding the impeller 200, as shown in FIG. 12.

As is clear from FIGS. 5 and 6, the paddles 210 are generally curved. Furthermore, they are preferably shaped and oriented to develop a fluid stream (e.g. air, water, or oil) through the centrifugal cutting apparatus upon rotation of the impeller. In particular, the impeller paddles 210 are shaped and oriented like blades of a centrifugal fan and configured to draw fluid from the interior space of the impeller 200 and push the fluid out through the exit openings provided at the cutting elements on the cutting head. In this way, during operation, the (food) product F can be moved towards the cutting elements on the cutting head by means of centrifugal force as well as the fluid stream. This can be particularly advantageous for (food) products F of smaller sizes.

Figure 9:
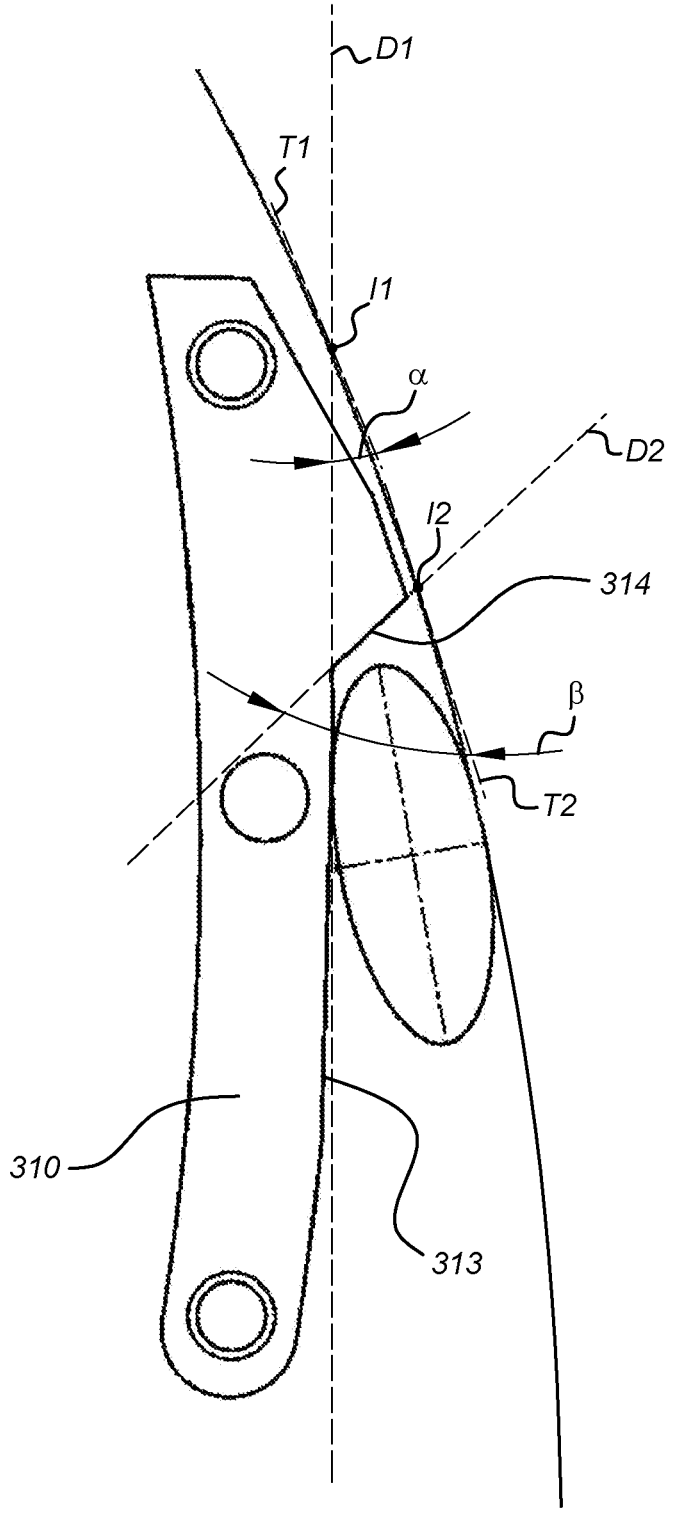
FIGS. 9 and 10 show cross-sectional views through other embodiments of impeller paddles.

FIG. 9 shows an alternative embodiment of an impeller paddle 310, wherein the paddle is a unit providing the first and second impelling surfaces 313, 314 on one and the same part. The first impelling surface 313 is a first planar part on the front side of the paddle 310, oriented in an angle $\alpha$ with respect to the circumference of the impeller. The second impelling surface 314 is a second planar part on the front side of the paddle 310, oriented in an angle $\beta$ with respect to the circumference of the impeller. The angles $\alpha$ and $\beta$ are similar to the embodiments described above.

Figure 10:
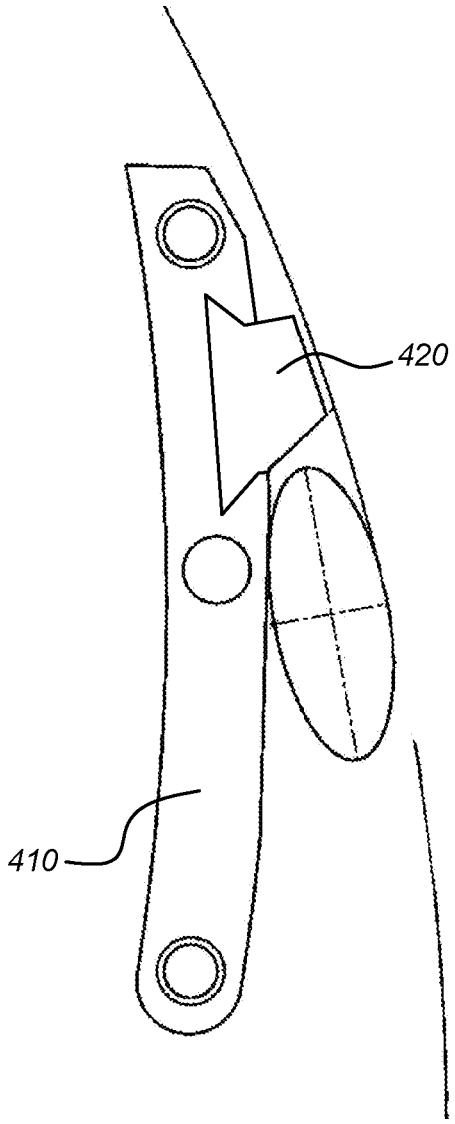

FIG. 10 shows yet an alternative embodiment of an impeller paddle 410, wherein the wear part 420 is fixed to the paddle 410 by means of a mechanical connection without bolts, for example a dovetail connection as shown. In this embodiment, the paddles 410 have slots which are complementary to the back side of the wear parts 420 and the wear parts are slided in from the top during assemblage of the impeller. Another example of such a mechanical connection without bolts is a tooth-and-groove connection.

In the embodiments of FIGS. 1-12, the impeller paddles extend in vertical direction, i.e. perpendicular to the base plate. In alternative embodiments, the impeller paddles may extend in slanting directions with respect to the base plate, such that the first and/or second impelling surfaces can push or hold down the product as it is being cut.

Figure 11:
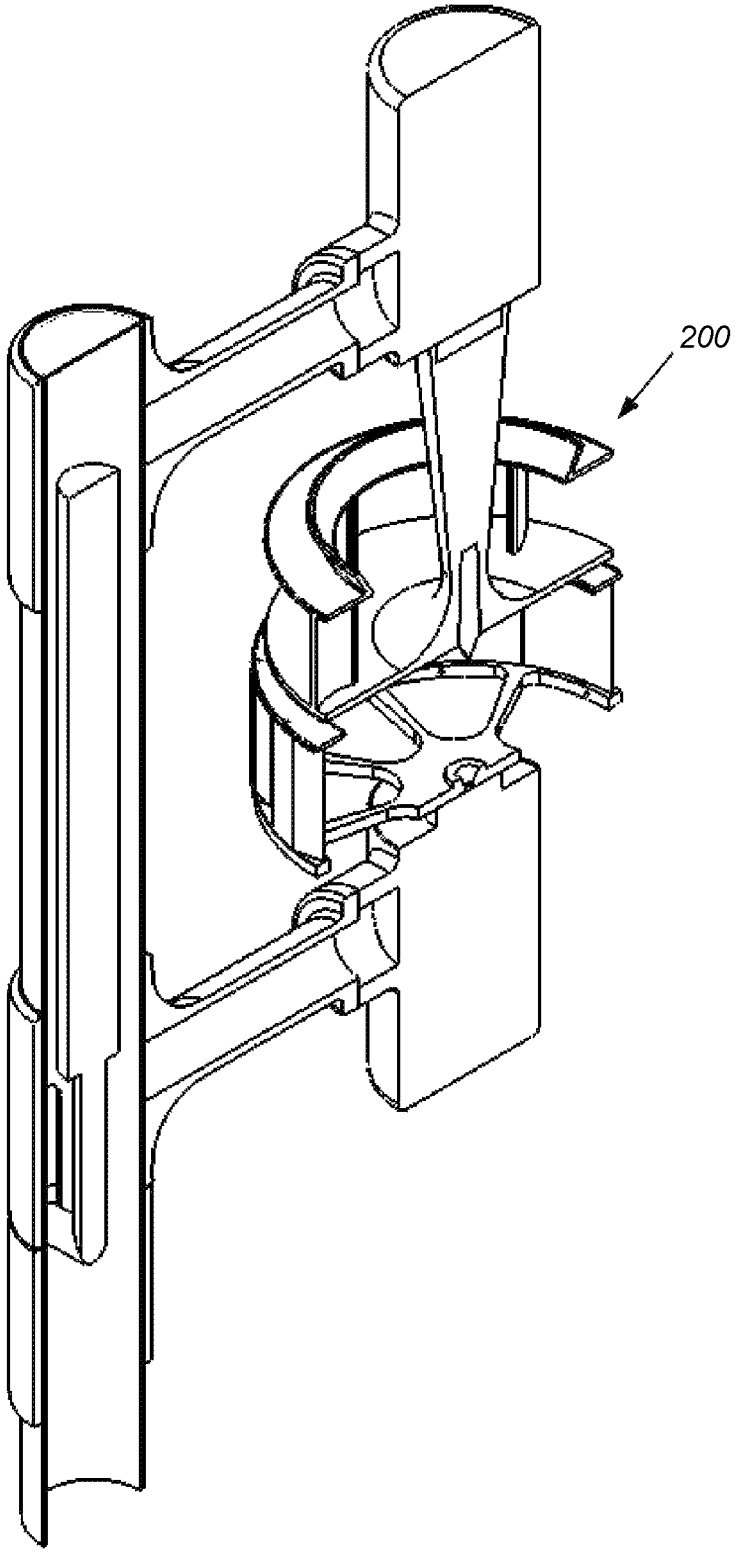
Prior Art Fig. 11
FIG. 11 shows perspective view of a centrifugal cutting apparatus comprising an impeller.

The impellers of FIGS. 1-12 can be used in machines with a horizontal rotation axis, a vertical rotation axis, or a rotation axis in slanting direction (e.g. 45° with respect to vertical). The direction of the rotation axis can be chosen, or varied, to optimize the use of the cutting elements on the cutting head, i.e. to make use of more of their length. Furthermore, the impeller may be driven by means of a reciprocating drive shaft, which moves the base plate of the impeller upwards and downwards while rotating, likewise to make use of more of the length of the cutting elements on the cutting head. Apparatuses comprising a cutting head and impeller 200 are shown in FIGS. 11, 12.

The invention claimed is:

1. An impeller for a centrifugal cutting apparatus, the impeller provided for being coaxially mounted within an annular-shaped cutting head of the cutting apparatus and to be rotated inside the cutting head about a rotational axis in a rotational direction, the impeller comprising:

a base plate closing one axial end of the impeller, an annular cover plate at an opposite axial end of the impeller, the annular cover plate defining a central opening for admission of product to be cut into the impeller, and a plurality of circumferentially spaced paddles mounted between the base and cover plates, wherein each of the paddles comprises:

an inner edge, an outer edge and a first impelling surface between the inner edge and the outer edge, the first impelling surface directed towards the rotational direction and an outer circumference of the base plate of the impeller, a majority portion of the first impelling surface exposed for contact with the product as the impeller rotates to drive the product that is admitted into the impeller forwards and radially outwards, a peripheral part, the peripheral part forming a part of the first impelling surface on a side of the paddle located closest to the outer circumference, and one or more replaceable wear parts, removably mounted to the peripheral part, each of the one or more wear parts protruding from the first impelling surface at the peripheral part of the paddle, the one or more wear parts forming a second impelling surface exposed for contact with the product, and each of the one or more wear parts covering a portion of the peripheral part while leaving exposed said majority portion of the first impelling surface that is exposed for contact with the product, and wherein for each of the paddles:

a first tangent line extends tangential to a center of the first impelling surface and extends in a first direction;

a second tangent line extends tangential to the second impelling surface and extends in a second direction;

a first angle is formed between the first tangent line and a third tangent line drawn at an intersection of the first tangent line with the outer circumference of the base plate;

a second angle is formed between the second tangent line and a fourth tangent line drawn at an intersection of the second tangent line with the outer circumference of the base plate; and the first angle is a smaller angle than the second angle.

2. The impeller according to claim 1, wherein, for each of the paddles, the one or more wear parts are removably fixed to the peripheral part of the paddle.

3. The impeller according to claim 1, wherein each first impelling surface is oriented to direct a longitudinal axis of said product so as to obtain oblong or oval cuts along the longitudinal axis of the product.

4. The impeller according to claim 1, wherein, for each of the paddles, the one or more wear parts are removably fixed in a slot which is provided in the peripheral part of the paddle, and the slot is provided to accomodate the one or more wear parts of the paddle.

5. The impeller according to claim 1, further comprising at least one annular divider plate disposed axially between said base and cover plates and generally in parallel with the base and the cover plates.

6. The impeller according to claim 5, wherein the one or more wear parts function as positioning elements for positioning the at least one divider plate axially between said base and cover plates.

7. The impeller according to claim 5, wherein the at least one divider plate comprises holes dimensioned for accommodating the paddles, said holes being located inwards from an outer circumference of the respective divider plate, such that the outer circumference of the divider plate is a continuous ring.

8. The impeller according to claim 1, wherein the second angle is about 45°.

9. The impeller according to claim 1, wherein the second angle is between 60° and 80°.

10. The impeller according to claim 1, wherein the first angle is an angle below 45°.

11. The impeller according to claim 1, wherein the first angle is between 20° 30°.

12. The impeller according to claim 1, wherein, for each of the paddles, the first impelling surface is convex.

13. The impeller according to claim 1, wherein the paddles are curved and oriented to develop a fluid stream through the centrifugal cutting apparatus.

14. A centrifugal cutting apparatus comprising a cutting head and the impeller according to claim 1.

15. A method of using the centrifugal cutting apparatus of claim 14, comprising the steps of:

rotating the impeller inside the cutting head;

admitting product into the impeller, elements of the product having an oblong shape;

guiding the elements of the product along trajectories towards the paddles of the impeller, the guiding performed by back sides of the paddles of the impeller when the impeller is rotationally driven; and rotating the elements of the product that are undesirably oriented which travel along said trajectories into an orientation desired for cutting, by intercepting each element of the product that is undesirably oriented by means of an inner extremity of a respective one of the paddles of the impeller.

16. The impeller according to claim 15, wherein each element of the product, after being intercepted, is impelled by means of one of the first impelling surfaces, and wherein the first angle is an angle below 45°.

17. The method according to claim 16, wherein each element of the product, after being impelled by means of one of the first impelling surfaces is impelled by means of one of the second impelling surfaces, wherein the second angle is an angle above 45°.

18. The method according to claim 15, wherein the paddles are curved.

19. The method according to claim 15, wherein the impeller is rotated at a speed of at least 500 RPM.

20. The method according to claim 15, wherein the product has a predetermined average size and oblong shape with an average length L measured along a longitudinal axis of the product, and wherein each of the inner extremities of the paddles is positioned a predetermined distance from the respective trajectory, said predetermined distance being between L/2 and L.

* * * * *